US007158156B2

(12) United States Patent
Endou

(10) Patent No.: US 7,158,156 B2
(45) Date of Patent: Jan. 2, 2007

(54) DISPLAY PANEL DRIVER

(75) Inventor: Shinji Endou, Yamagata (JP)

(73) Assignee: NEC Electronics Corporation, Kawasaki (JP)

( * ) Notice: Subject to any disclaimer, the term of this patent is extended or adjusted under 35 U.S.C. 154(b) by 326 days.

(21) Appl. No.: 10/647,756

(22) Filed: Aug. 25, 2003

(65) Prior Publication Data

US 2004/0036706 A1 Feb. 26, 2004

(30) Foreign Application Priority Data

Aug. 26, 2002 (JP) ..... 2002-245483

(51) Int. Cl.

| | |
|---|---|
| ***G09G 3/12*** | (2006.01) |
| ***G09G 3/28*** | (2006.01) |
| ***G09G 3/30*** | (2006.01) |
| ***G09G 3/32*** | (2006.01) |
| ***G09G 3/36*** | (2006.01) |

(52) U.S. Cl. ..... 345/690; 345/45; 345/63; 345/76; 345/77; 345/83; 345/89

(58) Field of Classification Search ..... 345/204, 345/690, 44, 45, 51, 76, 77, 87, 89, 212, 345/63, 83, 88

See application file for complete search history.

(56) References Cited

U.S. PATENT DOCUMENTS

| | | | | |
|---|---|---|---|---|
| 6,275,207 | B1 | 8/2001 | Nitta et al. | |
| 6,534,804 | B1 | 3/2003 | Tsuchiya | |
| 6,570,560 | B1 * | 5/2003 | Hashimoto | 345/690 |
| 6,633,270 | B1 | 10/2003 | Hashimoto | |
| 6,753,880 | B1 * | 6/2004 | Kudo et al. | 345/690 |
| 6,765,551 | B1 | 7/2004 | Nakano et al. | |
| 6,831,620 | B1 * | 12/2004 | Nishikubo et al. | 345/87 |
| 2001/0052897 | A1 | 12/2001 | Nakano et al. | |
| 2002/0000985 | A1 * | 1/2002 | Hashimoto | 345/212 |
| 2002/0011976 | A1 | 1/2002 | Hashimoto | |
| 2002/0027551 | A1 * | 3/2002 | Nitta et al. | 345/204 |
| 2002/0066912 | A1 | 6/2002 | Tsuchiya | |
| 2002/0093475 | A1 | 7/2002 | Hashimoto | |
| 2002/0186231 | A1 * | 12/2002 | Kudo et al. | 345/690 |
| 2003/0001870 | A1 * | 1/2003 | Kageyama et al. | 345/690 |
| 2003/0122757 | A1 * | 7/2003 | Bu | 345/87 |

(Continued)

FOREIGN PATENT DOCUMENTS

| | | |
|---|---|---|
| JP | 2-271389 | 11/1990 |

(Continued)

OTHER PUBLICATIONS

Japanese Office Action dated Nov. 30, 2004 with partial translation.

(Continued)

*Primary Examiner*—Kee M. Tung
*Assistant Examiner*—Chante Harrison
(74) *Attorney, Agent, or Firm*—Katten Muchin Rosenman LLP

(57) ABSTRACT

A display panel driver has a single resistor string for gamma correction and a signal power supply, which have heretofore been required for each of red, green, and blue, and is small in size and has its power consumption reduced. Voltage generator including a single resistor string having n reference voltage terminals generates n reference voltages. Voltage selector selects and outputs m red gradation voltages Vr(0) through Vr(15), m green gradation voltages Vg(0) through Vg(15), and m blue gradation voltages Vb(0) through Vb(15) from the n reference voltages. The display panel driver provides all of a gamma correction curve for red, gamma correction curve for green, and a gamma correction curve for blue with a single resistor string and a pair of power supplies including a ground potential.

7 Claims, 13 Drawing Sheets

U.S. PATENT DOCUMENTS

2005/0200584 A1* 9/2005 Kudo et al. ..... 345/89

FOREIGN PATENT DOCUMENTS

| | | |
|---|---|---|
| JP | 6-348235 | 12/1994 |
| JP | 8-211367 | 8/1996 |
| JP | 10-108040 | 4/1998 |
| JP | 11-015442 | 1/1999 |
| JP | 11-175027 | 7/1999 |
| JP | 2000-020037 | 1/2000 |
| JP | 2001-042833 | 2/2001 |
| JP | 2001-092413 | 4/2001 |
| JP | 2002-40961 | 2/2002 |
| JP | 2002-82645 | 3/2002 |
| JP | 2002-83932 | 3/2002 |
| JP | 2002-175060 | 6/2002 |
| JP | 2002-215108 | 7/2002 |

OTHER PUBLICATIONS

Japanese Office Action in patent application JP 2002-245483 dated May 17, 2005, with partial translation.

* cited by examiner

DISPLAY PANEL DRIVER

BACKGROUND OF THE INVENTION

1. Field of the Invention

The present invention relates to a driver for energizing data lines of a display panel, and more particularly to a display panel driver for displaying information on a display panel while correcting different light-emitting characteristics of red, green, and blue light-emitting elements of the display panel.

2. Description of the Related Art

In recent years, color display units employing electro luminescence (hereinafter abbreviated as "EL") elements as self-emission elements have been put to practical use. FIG. 1 of the accompanying drawings is a block diagram of an EL display unit. As shown in FIG. 1, the EL display unit includes display panel 1 comprising a plurality of pixels 4 positioned at respective points of intersection between a plurality of data lines 2 and a plurality of scanning lines 3. Each of pixels 4 comprises EL element 9. EL elements 9 of pixels 4 that are selected by data lines 2 and scanning lines 3 emit light at an intensity according to drive voltages that are supplied over data lines 2.

The EL display unit also has data line driver 70 that is supplied with red input data Dr, green input data Dg, and blue input data Db and outputs drive voltages DV(1) through DV(k) to data lines 2. Data line driver 70 has drive controlling circuit 7 for controlling the timing to input and output data, and drive voltage generating circuit 71 for generating drive voltages to be output to data lines 2. The EL display unit further has scanning line driver 6 for controlling the scanning of scanning lines 3. In FIG. 1, each of input data Dr, Dg, Db is shown as comprising 4-bit data. However, each of input data Dr, Dg, Db may comprise 6-bit data, 8-bit data, or other data.

The EL elements have different light-emission characteristics for red, green, and blue. The drive voltages to be applied to the EL elements need to be processed for gamma correction depending on those different light-emission characteristics in order to display color images that are well balanced among red, green, and blue on the display panel. FIGS. 2(*a*) through 2(*c*) of the accompanying drawings show gamma correction curves for different colors. Specifically, FIG. 2(*a*) shows a gamma correction curve for red, FIG. 2(*b*) a gamma correction curve for green, and FIG. 2(*c*) a gamma correction curve for blue. Since display panels that employ EL elements need to carry out gamma correction according to the different gamma correction curves for red, green, and blue, the display panels need different gradation voltage generating circuits dedicated to red, green, and blue, respectively.

FIG. 3 of the accompanying drawings shows in block form conventional drive voltage generating circuit 71. As shown in FIG. 3, conventional drive voltage generating circuit 71 comprises red gradation voltage generating circuit 72 for being supplied with red power supply Vr and generating and outputting 4-bit voltages, i.e., 16 red gradation voltages Vr(0) through Vr(15), green gradation voltage generating circuit 73 for being supplied with green power supply Vg and generating and outputting 16 green gradation voltages Vg(0) through Vg(15), and blue gradation voltage generating circuit 74 for being supplied with blue power supply Vb and generating and outputting 16 blue gradation voltages Vb(0) through Vb(15). Red digital-to-analog converters (hereinafter referred to as "DACs") 12 convert red gradation voltages Vr(0) through Vr(15) into gradation voltages corresponding to 4-bit input data Dr, and output gamma-corrected voltages through buffer circuits 15 as drive voltages to data lines 2. Green DACs 13 convert green gradation voltages Vg(0) through Vg(15) into gradation voltages corresponding to 4-bit input data Dg, and output gamma-corrected voltages through buffer circuits 15 as drive voltages to data lines 2. Similarly, blue DACs 14 convert blue gradation voltages Vb(0) through Vb(15) into gradation voltages corresponding to 4-bit input data Db, and output gamma-corrected voltages through buffer circuits 15 as drive voltages to data lines 2.

Details of the gradation voltage generating circuits and the DACs are disclosed in Japanese laid-open patent publication No. 2002-175060 (referred to as "first background art"), for example. As shown in FIG. 4 of the accompanying drawings, red gradation voltage generating circuit 72 divides the voltage supplied from red power supply Vr with resistors whose resistances have been selected for correction, generating and outputting red gradation voltages Vr(0) through Vr(15). Similarly, green gradation voltage gen-generating circuit 73 divides the voltage supplied from green power supply Vg with resistors whose resistances have been selected for correction, generating and outputting green gradation voltages Vg(0) through Vg(15). Blue gradation voltage generating circuit 74 divides the voltage supplied from blue power supply Vb with resistors whose resistances have been selected for correction, generating and outputting blue gradation voltages Vb(0) through Vb(15). Red DAC 12*a* has switches corresponding to the respective bits. Based on 4-bit red input data Dr, the switches are selectively opened and closed to select and output one of the gradation voltages. For example, if 4-bit red input data Dr represents (100), i.e., (8 h), then red DAC 12*a* selects and outputs gradation voltage Vr(8). Green DACs 13 and blue DACs 14 are also similarly constructed.

According to the first background art, however, since the gradation voltage generating circuits dedicated to red, green, and blue are required, there are required red, green, and blue power supplies, and also resistor strings having respective resistances selected for correction with respect to red, green, and blue. Consequently, data line driver 70 cannot be reduced in size, and cannot have its power consumption reduced.

Japanese laid-open patent publication No. 2001-92413 (referred to as "second background art") discloses a conventional EL display unit which directly performs gamma correction on a video signal. FIG. 5 of the accompanying drawings shows in block form the conventional EL display unit according to the second background art. As shown in FIG. 5, video signal correcting circuit 82 is supplied with red input data Dr, green input data Dg, and blue input data Db, and corrects these input data in order to amplify or attenuate them based on corrective data stored in corrective memory 83. For example, video signal correcting circuit 82 corrects red input data Dr in order to amplify them, and outputs corrected red input data CDr to data line driver 81. Green input data Dg and blue input data Db are similarly corrected by video signal correcting circuit 82, which output corrected green input data CDg and corrected blue input data CDb to data line driver 81. Inasmuch as the red, green, and blue input data are gamma-corrected by video signal correcting circuit 82 and then input to data line driver 81, data line driver 81 needs to have a single gradation voltage generating circuit, and hence is made up of a reduced number of parts and has its power consumption reduced.

According to the second background art, however, when the input data are amplified by video signal correcting circuit 82, the number of gradation voltages is essentially increased to the extent that digital input data applied to DACs will exceed the number of convertible bits of the DACs. When this happens, the output gradation voltages produced in response to the input data are saturated, resulting in color irregularities on displayed images.

SUMMARY OF THE INVENTION

A principal object of the present invention is to provide a data line driver circuit which has a gradation voltage generating circuit that is small in size and consumes low electric power and is capable of performing gamma correction on red, green, and blue input data with a single resistor string, and which is effective to prevent output gradation voltages from being saturated when digital input data are converted into analog output data.

According to the present invention, there is provided a display panel driver for being supplied with digital data for displaying red, green, and blue on a display panel having display elements, correcting differences between light-emission characteristics of the display elements for red, green, and blue using m gradation voltages for each of red, green, and blue, and generating and outputting drive voltages for data lines of the display panel, the display panel driver comprising voltage generating means for generating reference voltages, the voltage generating means having a plurality of resistors connected in series between a first high-voltage power supply and a second low-voltage power supply, and n reference voltage terminals, which are more than the m gradation voltages, connected to respective junctions at which the resistors are connected, and voltage selecting means for selecting and outputting m red gradation voltages, m green gradation voltages, and m blue gradation voltages from the reference voltages supplied from the n reference voltage terminals. In addition, the display panel driver may also include red digital-to-analog converters each for selecting and outputting one of the m red gradation voltages based on digital input data supplied thereto, green digital-to-analog converters each for selecting and outputting one of the m green gradation voltages based on digital input data supplied thereto, and blue digital-to-analog converters each for selecting and outputting one of the m blue gradation voltages based on digital input data supplied thereto.

The above and other objects, features, and advantages of the present invention will become apparent from the following description with reference to the accompanying drawings which illustrate examples of the present invention.

BRIEF DESCRIPTION OF THE DRAWINGS

FIG. 2(*b*) is a diagram showing a gamma correction curve for green;

FIG. 2(*c*) is a diagram showing a gamma correction curve for blue;

DETAILED DESCRIPTION OF THE PREFERRED EMBODIMENTS

Figure 1:
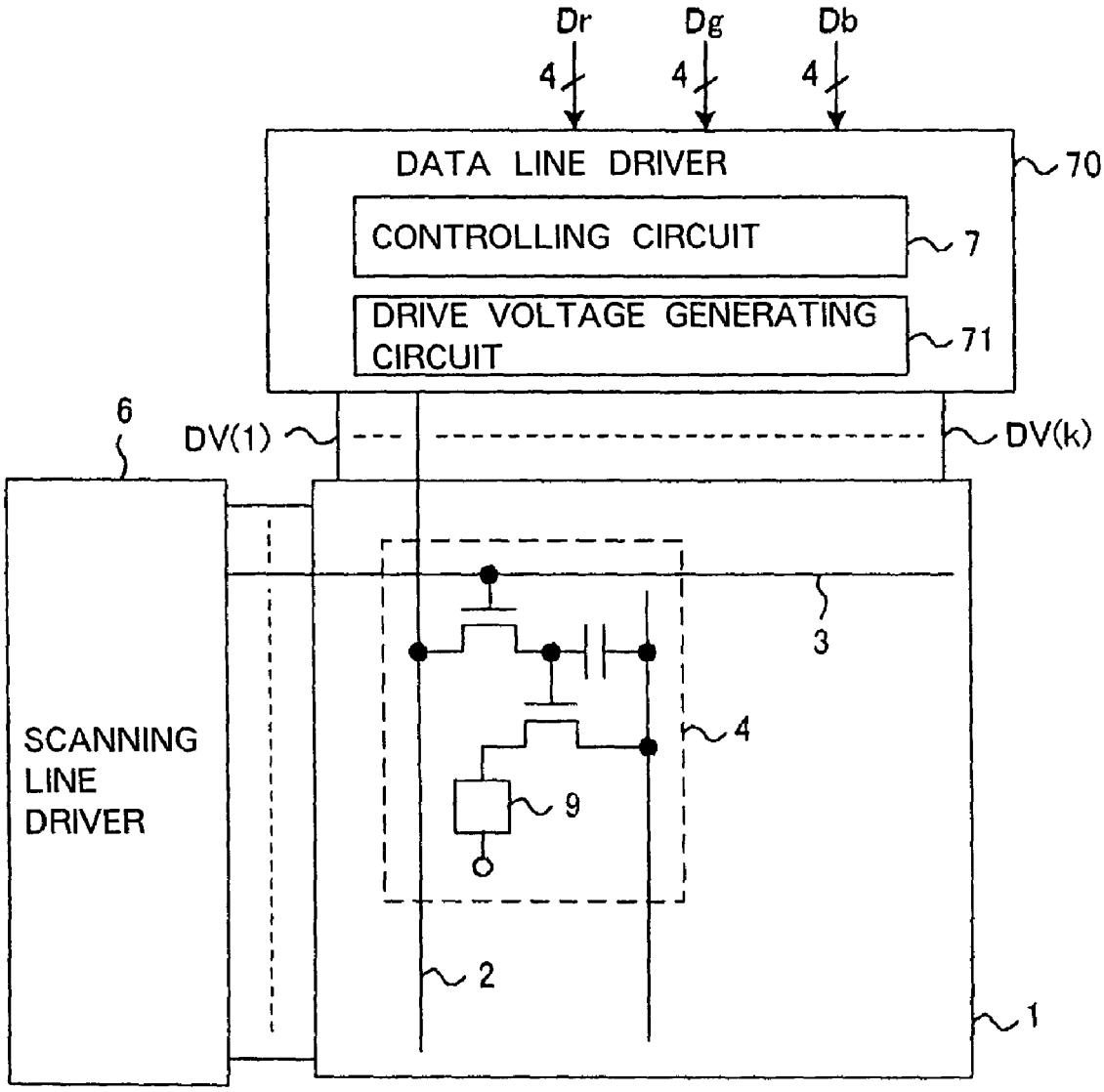
Fig.1 BACKGROUND ART
FIG. 1 is a block diagram of a conventional EL display unit.
Figure 6:
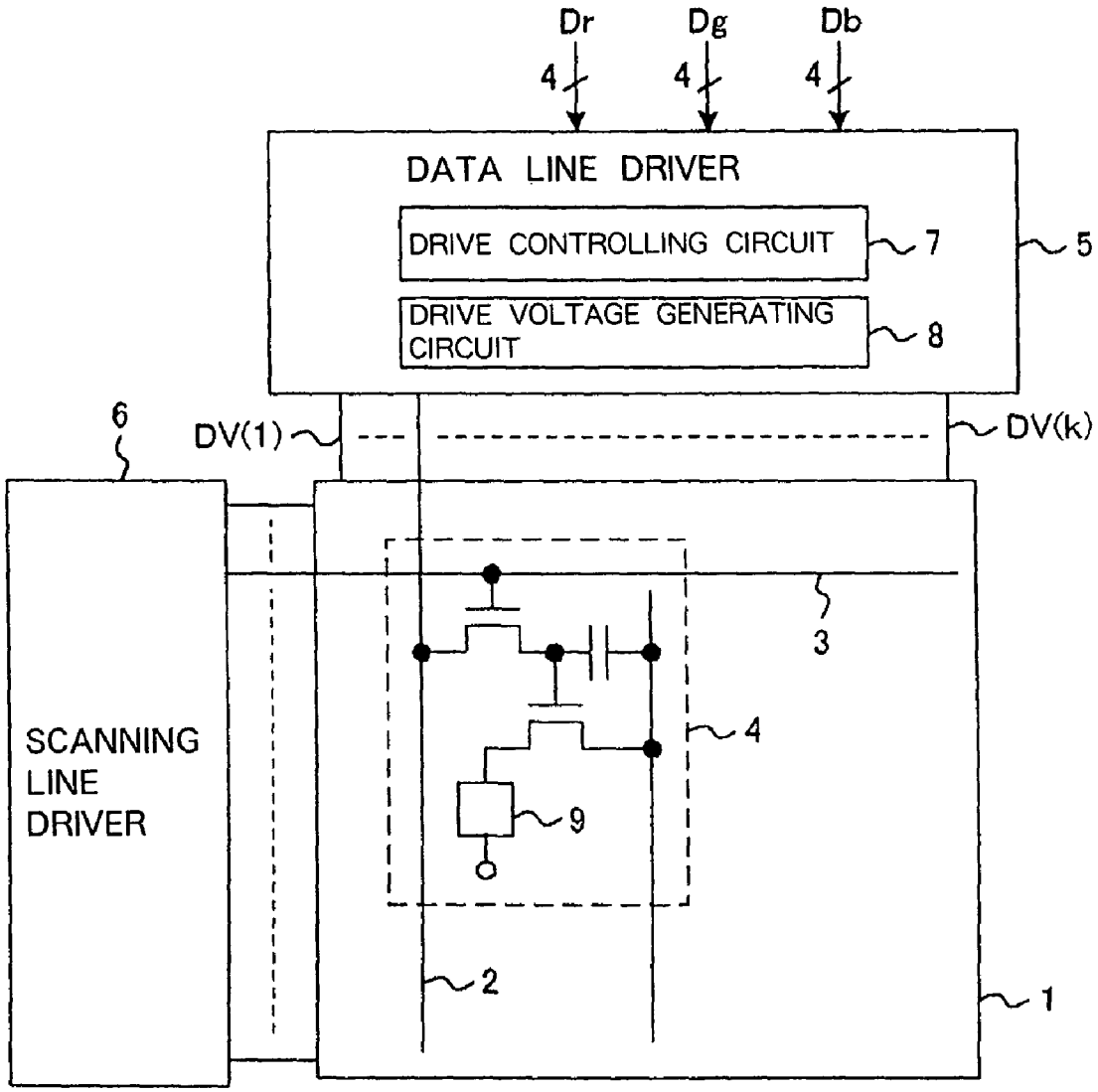
FIG. 6 is a block diagram of an EL display unit including a data line driver according to the present invention.

An embodiment of the present invention will first be described below with reference to FIGS. 6 through 8. FIG. 6 shows an EL display unit in block form, and corresponds to FIG. 1 showing the conventional EL display unit. As shown in FIG. 6, the EL display unit includes display panel 1 comprising a plurality of pixels 4 positioned at respective points of intersection between a plurality of data lines 2 and a plurality of scanning lines 3. Each of pixels 4 comprises EL element 9. EL elements 9 of pixels 4 that are selected by data lines 2 and scanning lines 3 emit light at an intensity according to drive voltages that are supplied over data lines 2.

Data line driver 5 according to the embodiment of the present invention is supplied with red input data Dr, green input data Dg, and blue input data Db and outputs drive voltages DV(1) through DV(k) to data lines 2. Data line driver 5 has drive controlling circuit 7 for controlling the timing to input and output data, and drive voltage generating circuit 8 for generating drive voltages to be output to data lines 2. The EL display unit further has scanning line driver 6 for controlling the scanning of scanning lines 3. In FIG. 6, each of input data Dr, Dg, Db is shown as comprising 4-bit data for illustrative purposes. However, each of input data Dr, Dg, Db may comprise 6-bit data, 8-bit data, or other data.

According to the present invention, data line driver 5 is employed in place of the data line driver 70 according to the first background art, and drive voltage generating circuit 8 is employed in place of drive voltage generating circuit 71 according to the first background art. FIG. 7 shows in block form drive voltage generating circuit 8a according to an embodiment of the present invention, illustrating details of drive voltage generating circuit 8. Drive voltage generating circuit 71 according to the first background art has three gradation voltage generating circuits for red, green, and blue. However, drive voltage generating circuit 8*a* according to the embodiment of the present invention has single gradation voltage generating circuit 11 for generating 4-bit, i.e., 16 red gradation voltages Vr(0) through Vr(15), 16 green gradation voltages Vg(0) through Vg(15), and 16 blue gradation voltages Vb(0) through Vb(15).

Red DACs 12 convert red gradation voltages Vr(0) through Vr(15) into gradation voltages corresponding to 4-bit input data Dr, and output gamma-corrected voltages through buffer circuits 15 as drive voltages to data lines 2.

Green DACs 13 convert green gradation voltages Vg(0) through Vg(15) into gradation voltages corresponding to 4-bit input data Dg, and output gamma-corrected voltages through buffer circuits 15 as drive voltages to data lines 2. Similarly, blue DACs 14 convert blue gradation voltages Vb(0) through Vb(15) into gradation voltages corresponding to 4-bit input data Db, and output gamma-corrected voltages through buffer circuits 15 as drive voltages to data lines 2.

Figure 8:
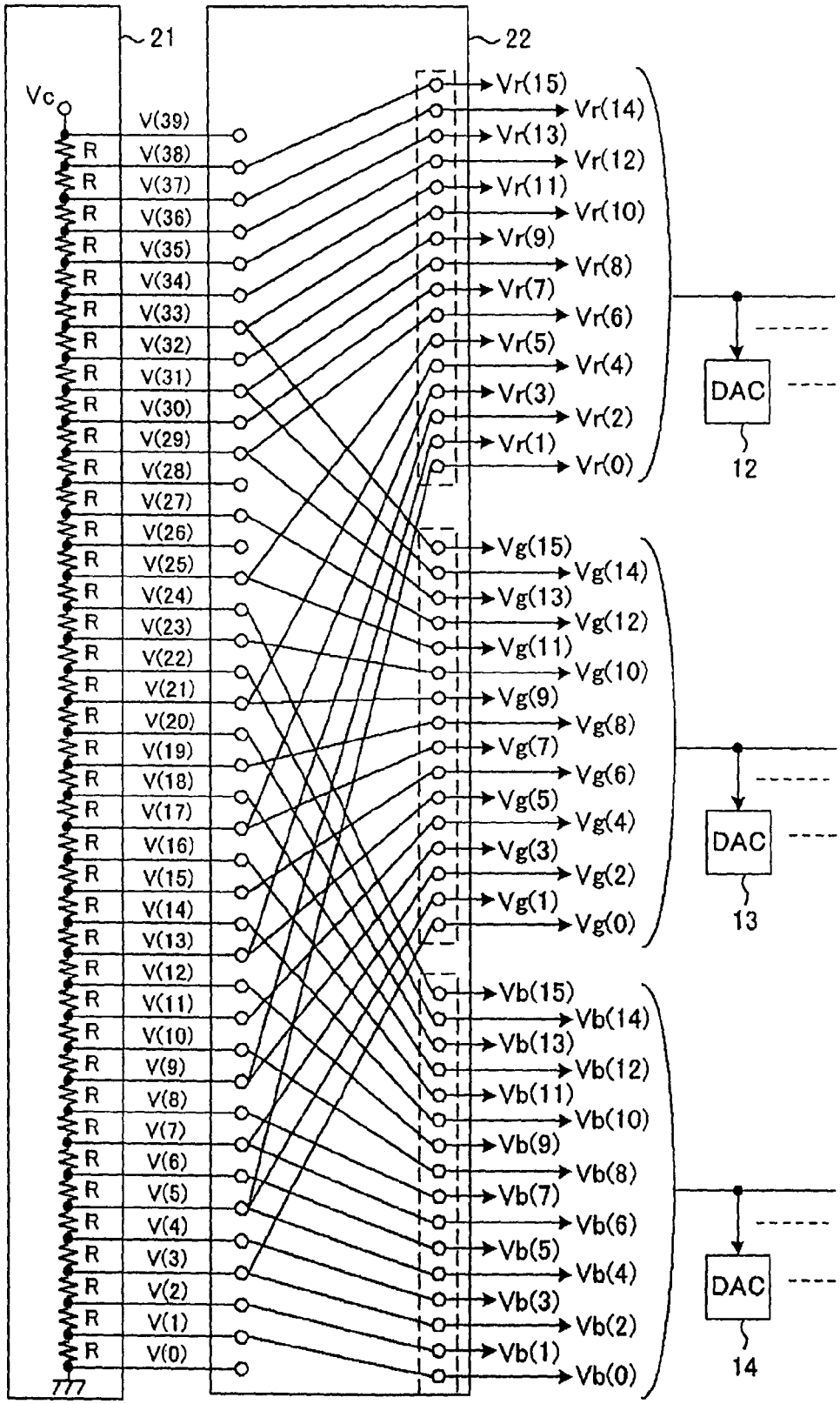
FIG. 8 is a circuit diagram of a gradation voltage generating circuit in the drive voltage generating circuit.

FIG. 8 shows in detail gradation voltage generating circuit 11 in drive voltage generating circuit 8*a*. As shown in FIG. 8, gradation voltage generating circuit 11 comprises voltage generating means 21 and voltage selecting means 22. Voltage generating means 21 comprises a plurality of resistors connected in series between power supply Vc as a first voltage power supply and ground as a second voltage power supply. The resistors are connected at junctions that are connected to n (n=40 in FIG. 8) reference voltage terminals which are more than m (m=16 in FIG. 8) types of red, green, and blue gradation voltages.

The resistors have their resistances set to the same value to output 40 reference voltages spaced at equal voltage intervals, ranging from V(0) at the ground potential to V(39) at the potential of power supply Vc, from the respective reference voltage terminals. Voltage selecting means 22 selects and outputs 16 red gradation voltages Vr(0) through Vr(15), 16 green gradation voltages Vg(0) through Vg(15), and 16 blue gradation voltages Vb(0) through Vb(15) from reference voltages V(0) through V(39) that are input from the 40 reference voltage terminals.

For example, as shown in FIG. 8, voltage selecting means 22 selects reference voltage V(5) as red gradation voltage Vr(0), reference voltage V(9) as red gradation voltage Vr(1), reference voltage V(13) as red gradation voltage Vr(2), reference voltage V(17) as red gradation voltage Vr(3), reference voltage V(21) as red gradation voltage Vr(4), reference voltage V(25) as red gradation voltage Vr(5), reference voltage V(29) as red gradation voltage Vr(6), reference voltage V(30) as red gradation voltage Vr(7), reference voltage V(31) as red gradation voltage Vr(8), reference voltage V(32) as red gradation voltage Vr(9), reference voltage V(33) as red gradation voltage Vr(10), reference voltage V(34) as red gradation voltage Vr(11), reference voltage V(35) as red gradation voltage Vr(12), reference voltage V(36) as red gradation voltage Vr(13), reference voltage V(37) as red gradation voltage Vr(14), and reference voltage V(38) as red gradation voltage Vr(15), thus outputting 16 red gradation voltages Vr(0) through Vr(15).

Figure 2A:
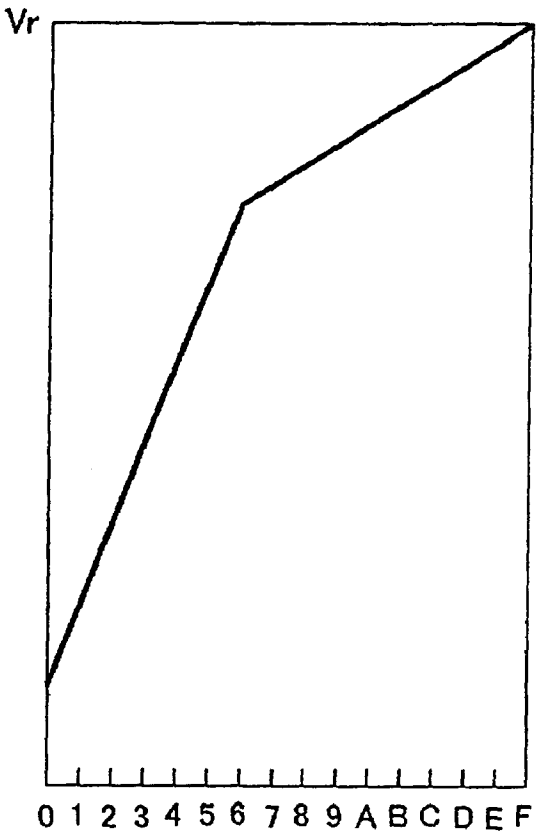
Fig.2(a) BACKGROUND ART
FIG. 2(*a*) is a diagram showing a gamma correction curve for red.
Figure 2B:
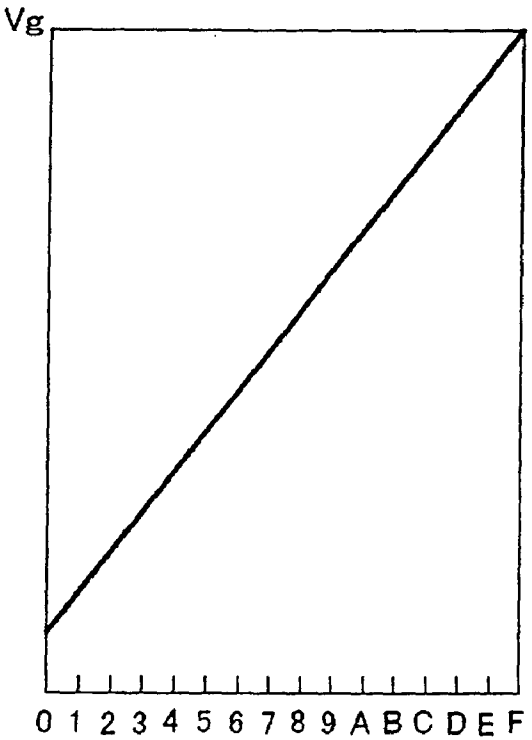
Fig.2(b) BACKGROUND ART
Figure 2C:
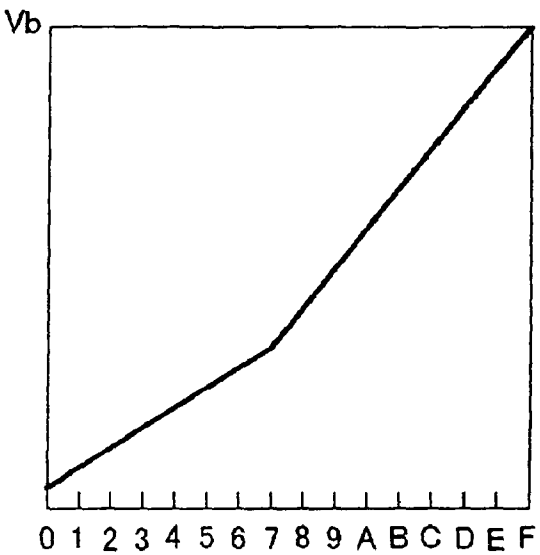
Fig.2(c) BACKGROUND ART
Figure 3:
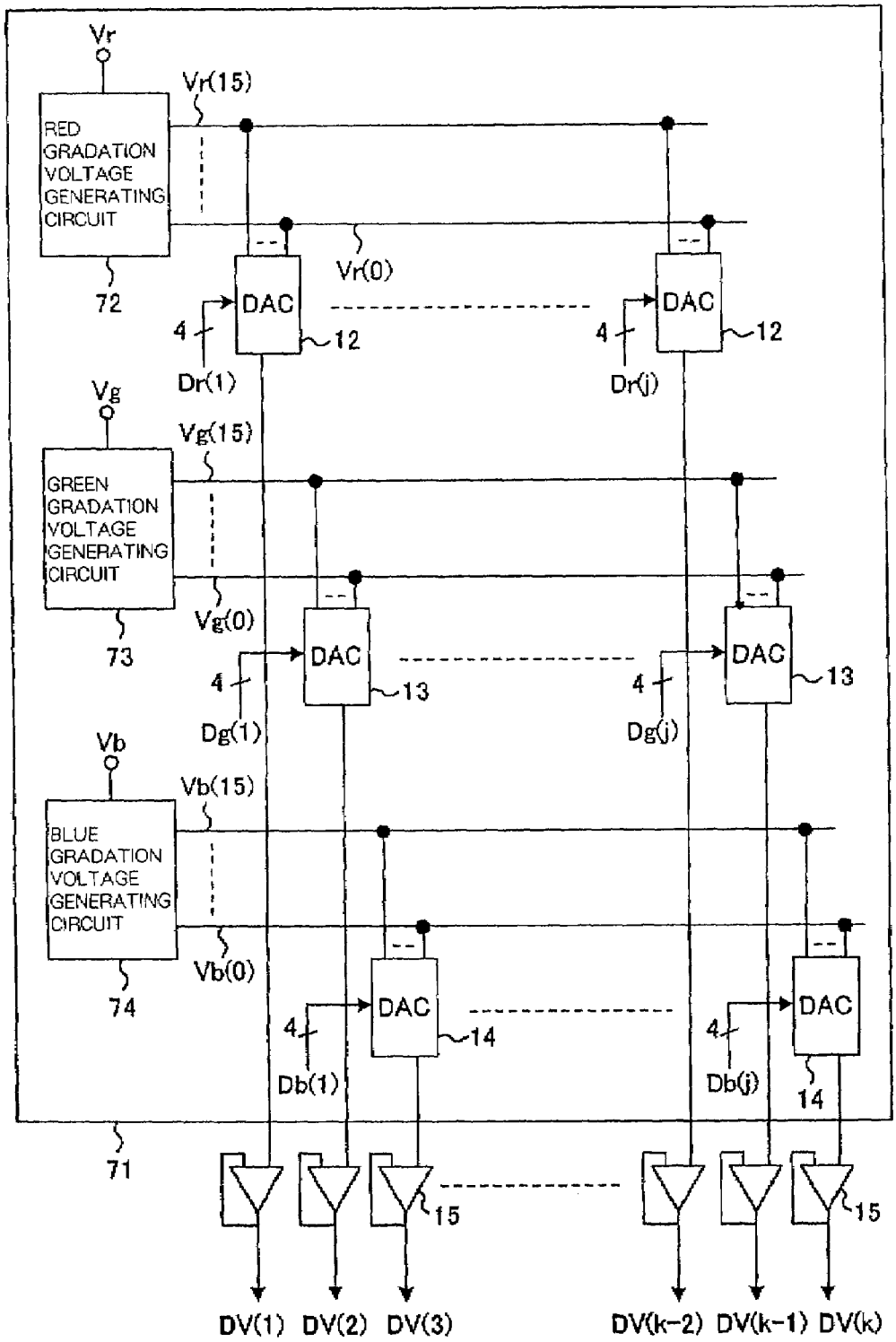
Fig.3 BACKGROUND ART
FIG. 3 is a block diagram of a gradation voltage generating circuit according to the first background art.
Figure 4:
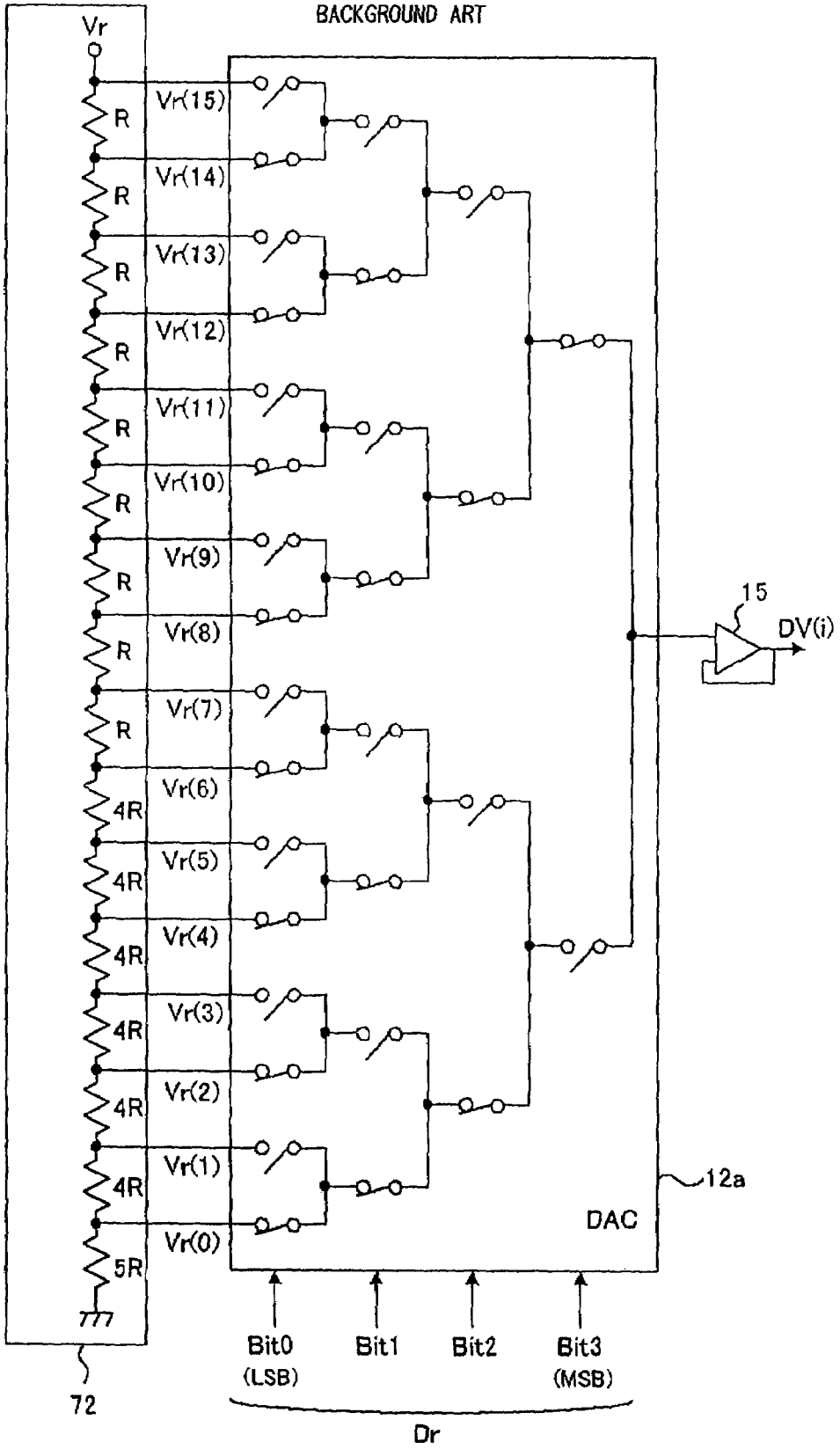
Fig.4 BACKGROUND ART
FIG. 4 is a circuit diagram of a gradation voltage generating circuit and DACs combined therewith according to the first background art.
Figure 5:
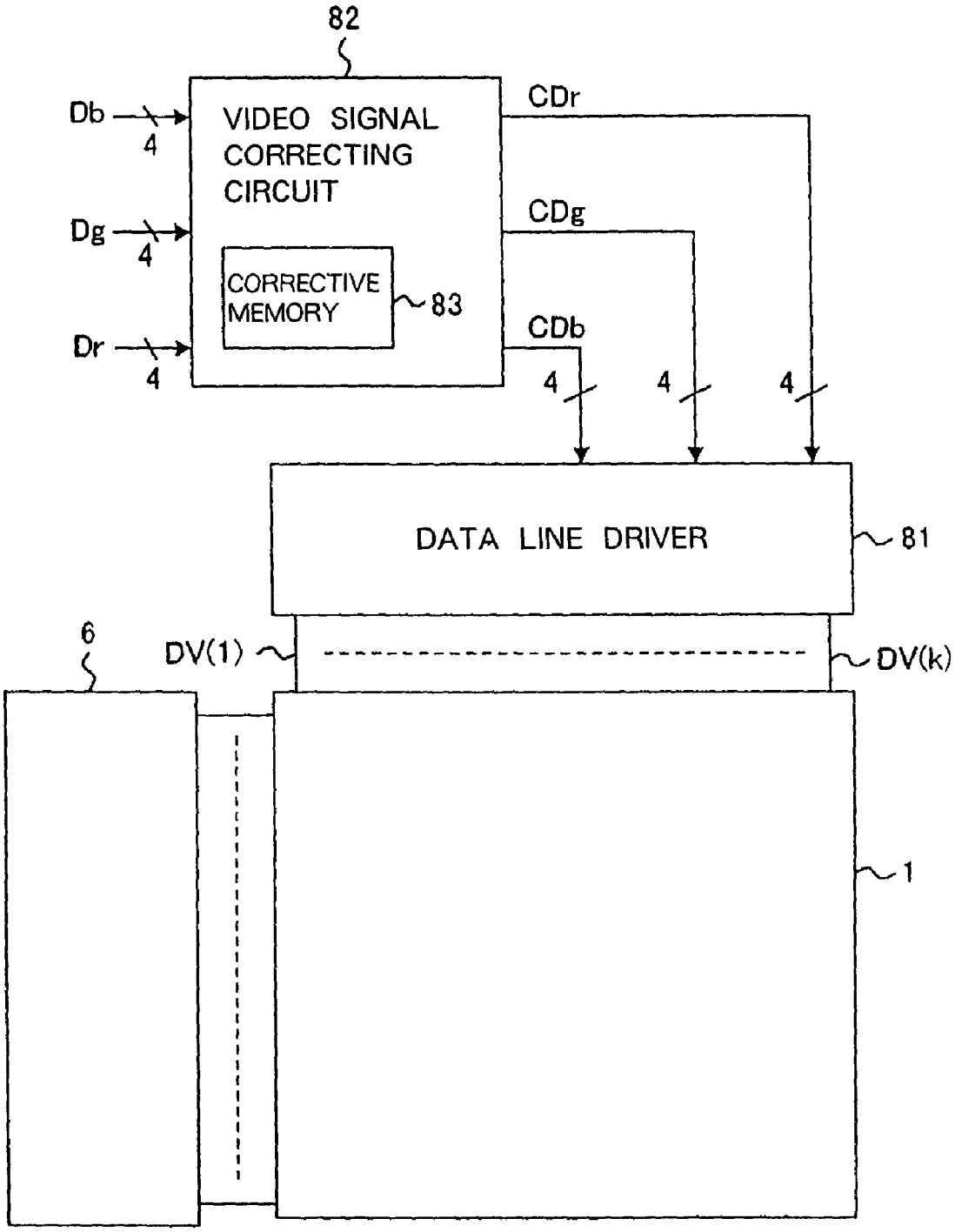
Fig.5 BACKGROUND ART
FIG. 5 is a block diagram of an EL display unit according to the second background art.
Figure 9:
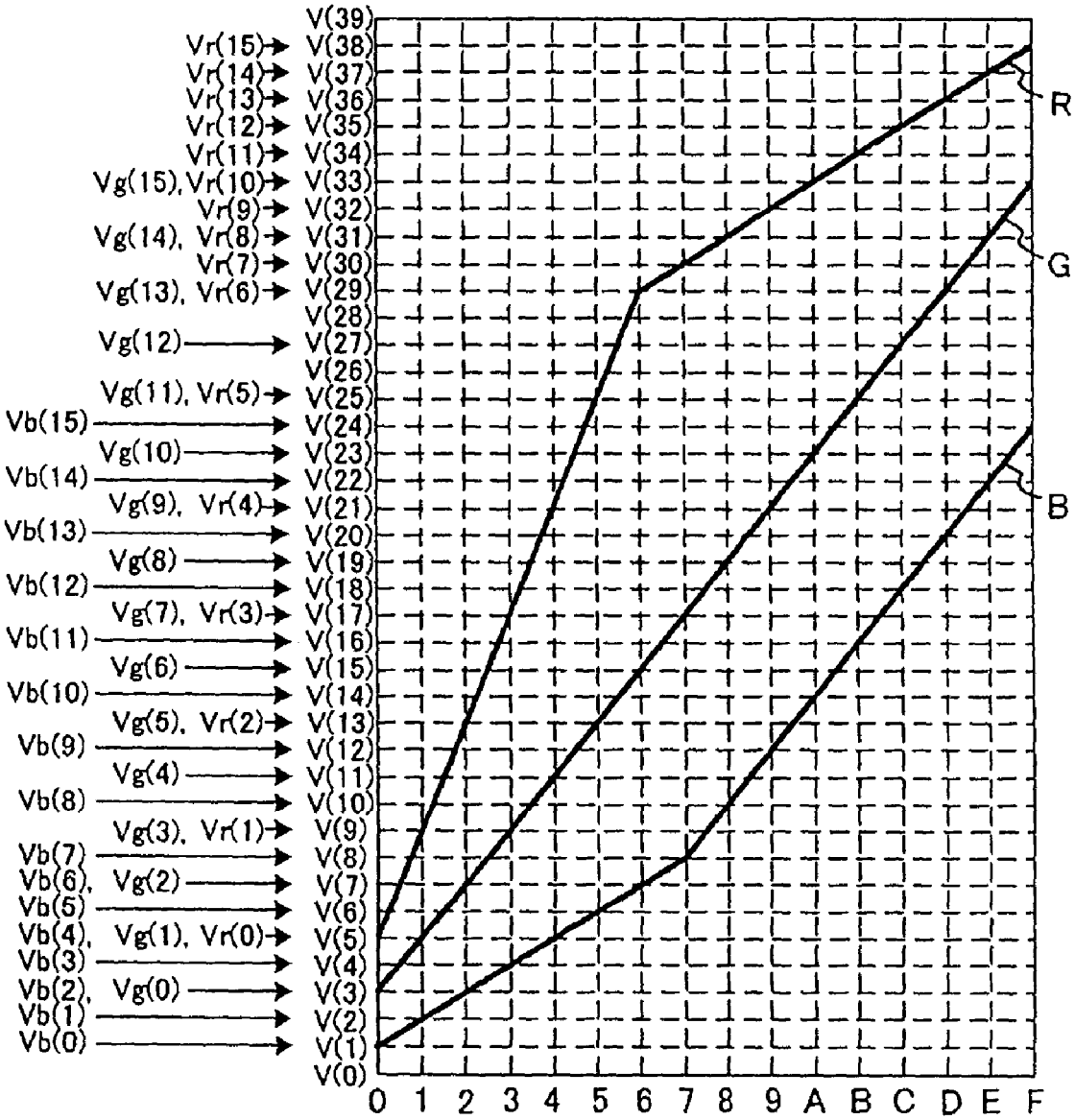
FIG. 9 is a diagram showing gamma correction curves of the gradation voltage generating circuit.

In this manner, voltage selecting means 22 selects and outputs 16 red gradation voltages Vr(0) through Vr(15), 16 green gradation voltages Vg(0) through Vg(15), and 16 blue gradation voltages Vb(0) through Vb(15) from reference voltages V(0) through V(39) that are input from the 40 reference voltage terminals, thereby providing all of the gamma correction curve for red shown in FIG. 2(*a*), the gamma correction curve for green shown in FIG. 2(*b*), and the gamma correction curve for blue shown in FIG. 2(*c*), using a single resistor string comprising 39 resistors and the power supply Vc, as indicated by gamma correction curves in FIG. 9. According to the first background art, a resistor string comprising 16 resistors and a dedicated power supply need to be provided for each of red, green, and blue. According to the present invention, however, the number of resistor strings and the number of power supplies are greatly reduced, and the gradation voltage generating circuit is small in size and consumes low electric power, compared with the first background art shown in FIGS. 1 through 4. According to the present invention, furthermore, the number of gradation voltages for each of red, green, and blue is 16. Since the number of gradation voltages is not increased unlike the second background art shown in FIG. 5, output gradation voltages are prevented from being saturated when digital input data are converted into analog output data, thus avoiding color irregularities on displayed images.

Figure 10:
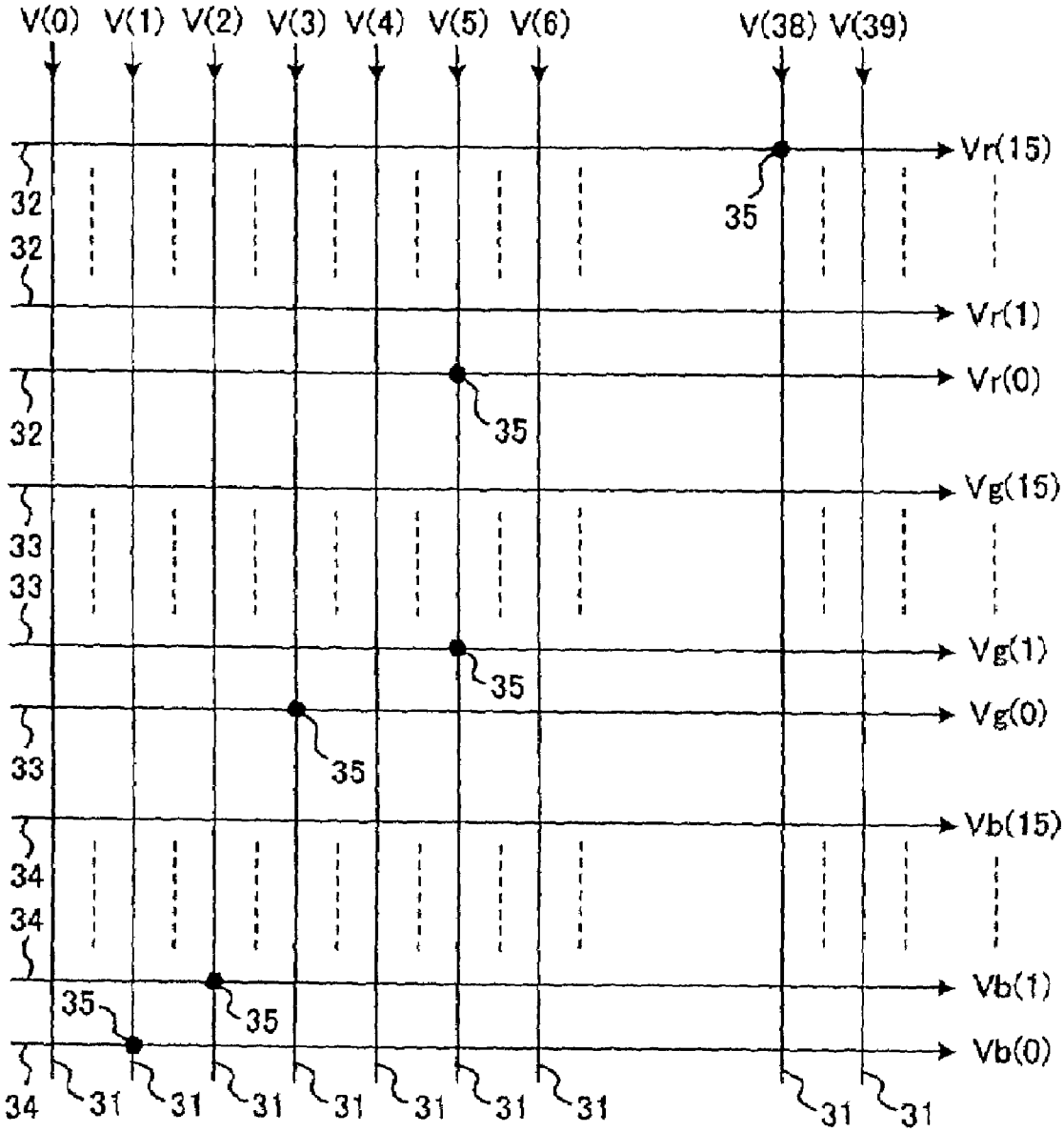
FIG. 10 is a circuit diagram of a voltage selecting means according to an embodiment of the present invention.

FIG. 10 shows voltage selecting means 22 according to an embodiment of the present invention, illustrating details of voltage selecting means 22 shown in FIG. 8. As shown in FIG. 10, voltage selecting means 22 comprises n (n=40 in FIG. 10) reference voltage input lines 31 extending in a first direction and connected respectively to the reference voltage terminals of voltage generating means 21, and m (m=16 in FIG. 10) red gradation voltage output lines 32, m green gradation voltage output lines 33, and m blue gradation voltage output lines 34 all extending in a second direction perpendicular to the first direction. Voltage selecting means 22 also has connecting means 35 disposed at points of intersection between lines in the first direction and lines in the second direction, for selectively connecting red gradation voltage output lines 32 to one of reference voltage input lines 31, selectively connecting green gradation voltage output lines 33 to one of reference voltage input lines 31, and selectively connecting blue gradation voltage output lines 34 to one of reference voltage input lines 31. If vias defined at points of intersection between lines in the first direction and lines in the second direction are used as connecting means 35, then voltage selecting means 22 can be reduced in size. In FIG. 10, voltage selecting means 22 is arranged to output reference voltage V(38) as red gradation voltage Vr(15) and to output reference voltage V(5) as red gradation voltage Vr(0).

Figure 11:
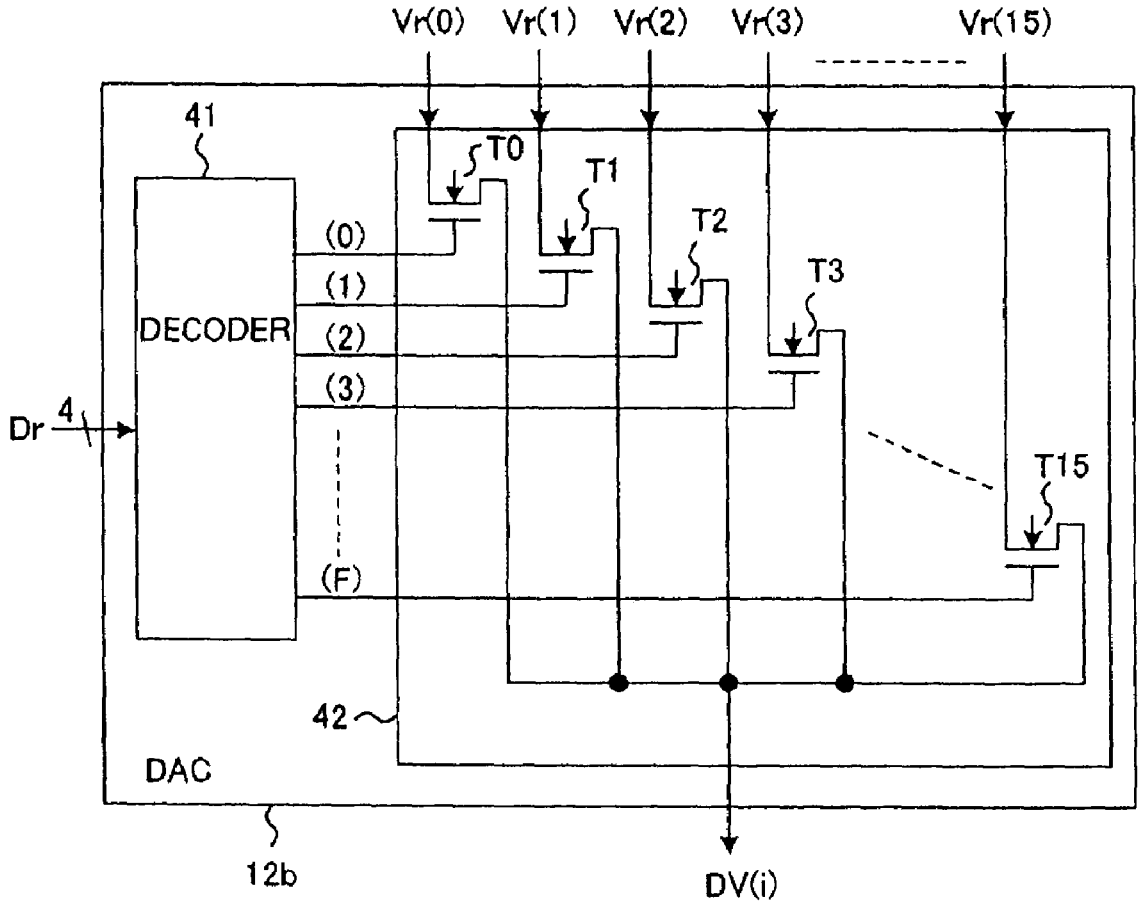
FIG. 11 is a circuit diagram, partly in block form, of a DAC according to an embodiment of the present invention.

Red gradation voltages Vr(0) through Vr(15) thus generated are supplied to red DAC 12, green gradation voltages Vg(0) through Vg(15) to green DAC 13, and blue gradation voltages Vb(0) through Vb(15) to blue DAC 14. Red, green, and blue DACs 12, 13, 14 convert the supplied voltages into analog drive voltages based on digital input data input thereto, and output the analog drive voltages through buffer circuits 15 to data lines 2. One example of the DACs is shown as DAC 12*a* in FIG. 4. However, the DACs may be constructed as DAC 12*b* as shown in FIG. 11. In FIG. 11, DAC 12*b* comprises decoder 41 for selecting one output line according to input data Dr, and selector 42 for selecting one of gradation voltages Vr(0) through Vr(15) based on the selected output line. DAC 12*b* outputs the converted gradation voltage corresponding to input data Dr.

Figure 12:
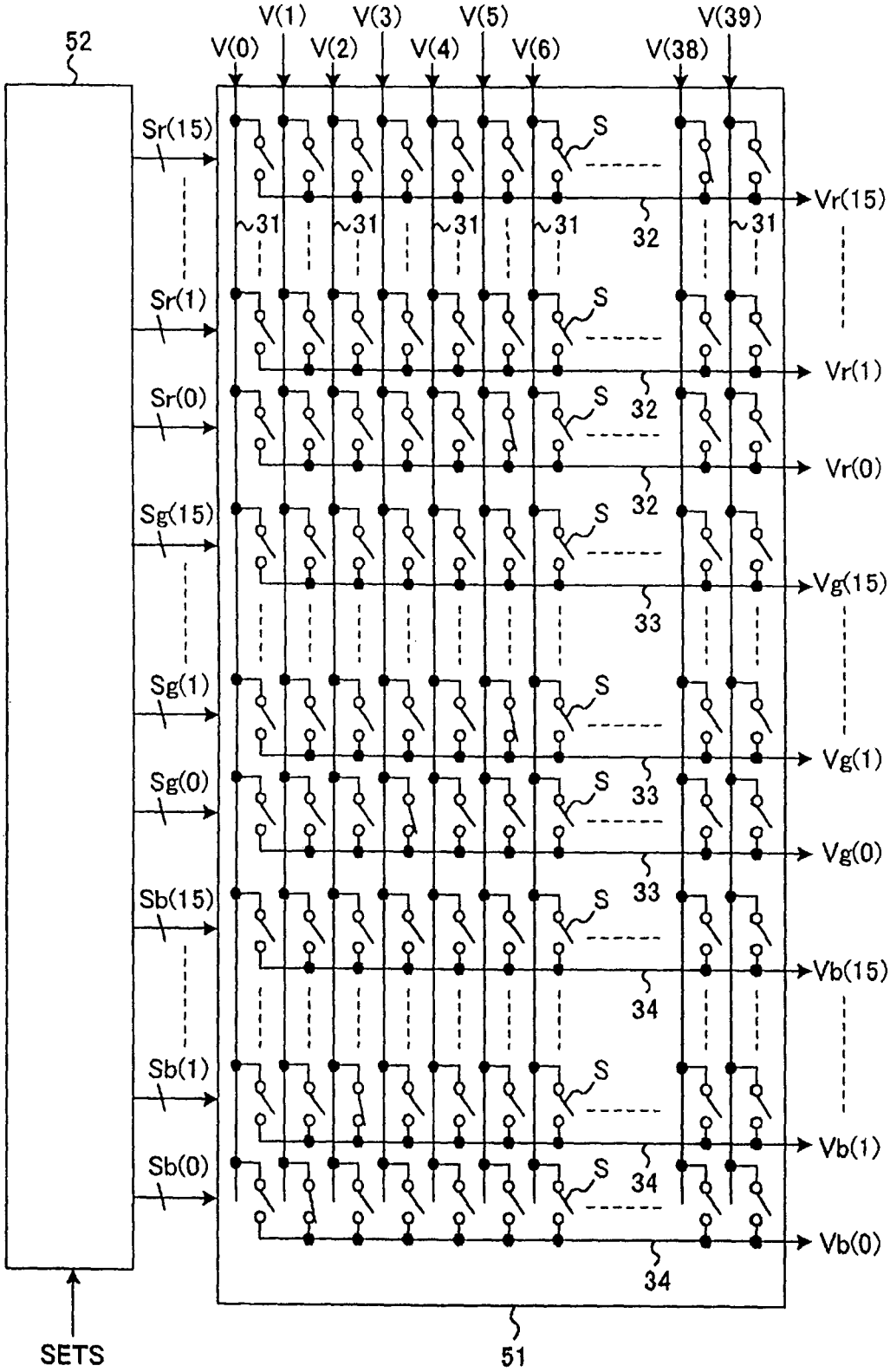
FIG. 12 is a circuit diagram of a voltage selecting means according to another embodiment of the present invention.

FIG. 12 shows voltage selecting means 22 according to another embodiment of the present invention. As shown in FIG. 12, voltage selecting means 22 comprises switch matrix 51 made up of a plurality of switches arranged in a matrix, and switch control circuit 52 for controlling the opening and closing of switch matrix 51. Switch matrix 51 have their switches S disposed at respective points of intersection between reference voltage input lines 31 extending in a first direction, and red gradation voltage output lines 32, green gradation voltage output lines 33, and blue gradation voltage output lines 34 all extending in a second direction. Switch control circuit 52 selects and renders conductive one of n (n=40 in FIG. 12) switches connected to each of red gradation voltage output lines 32 with one of switch control signals Sr(0) through Sr(15), selects and renders conductive one of 40 switches connected to each of green gradation voltage output lines 33 with one of switch control signals Sg(0) through Sg(15), and selects and renders conductive one of 40 switches connected to each of blue gradation voltage output lines 34 with one of switch control signals Sb(0) through Sb(15).

Voltage selecting means 22 that is constructed using the switch matrix shown in FIG. 12 makes it possible to selectively open and close switches S to change or finely adjust gamma correction curves with switch setting signal SETS that is applied from an external source to switch control circuit 52. For example, different EL display panels suffer red, green, and blue light-emission characteristic variations for reasons associated with their manufacturing processes. Such light-emission characteristic variations can be corrected by controlling the switches of voltage selecting means 22 of each of the EL display panels for appropriate gamma correction. The switches of voltage selecting means 22 may also be controlled in view of the effect of extraneous light that is applied differently when the EL display panel is used indoors and outdoors, for thereby adjusting the brightness of information displayed on the EL display panel for optimum viewing comfort.

Figure 13:
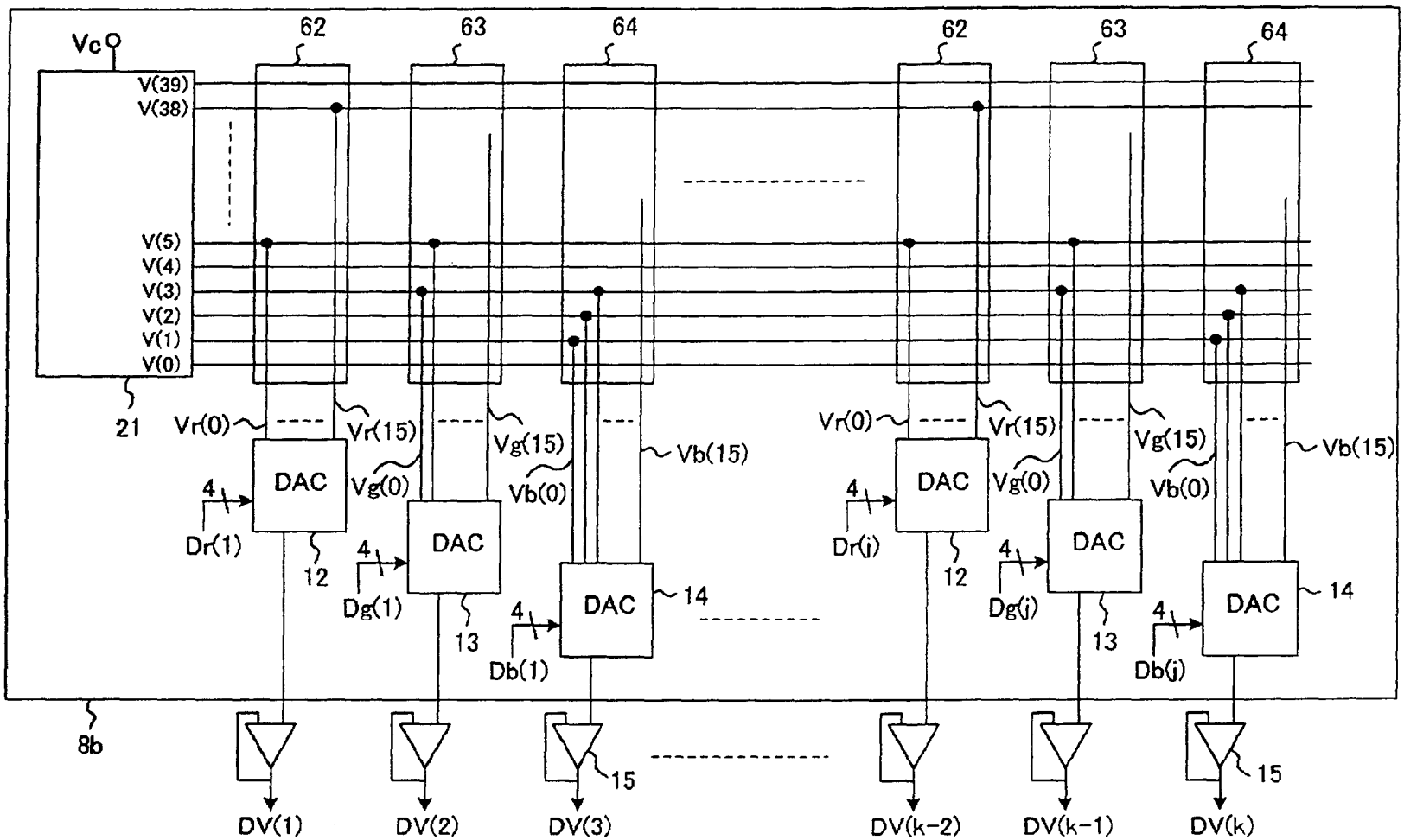
FIG. 13 is a block diagram of a drive voltage generating circuit according to another embodiment of the present invention.

FIG. 13 shows in block form drive voltage generating circuit 8*b* according to another embodiment of the present invention. As shown in FIG. 13, drive voltage generating circuit 8*b* has red voltage selecting means 62 associated respectively with red DACs 12, green voltage selecting means 63 associated respectively with green DACs 13, and blue voltage selecting means 64 associated respectively with blue DACs 14. Red voltage selecting means 62 select m (m=16 in FIG. 13) red gradation voltages from n (n=40 in FIG. 13) reference voltages V(0) through V(39) supplied from voltage generating means 21 and supply the selected m red gradation voltages to corresponding red DACs 12. Similarly, green voltage selecting means 63 select 16 green gradation voltages from 40 reference voltages V(0) through V(39) supplied from voltage generating means 21 and supply the selected 16 green gradation voltages to corresponding green DACs 13. Blue voltage selecting means 64 select 16 blue gradation voltages from 40 reference voltages V(0) through V(39) supplied from voltage generating means 21 and supply the selected 16 blue gradation voltages to corresponding blue DACs 14.

Figure 7:
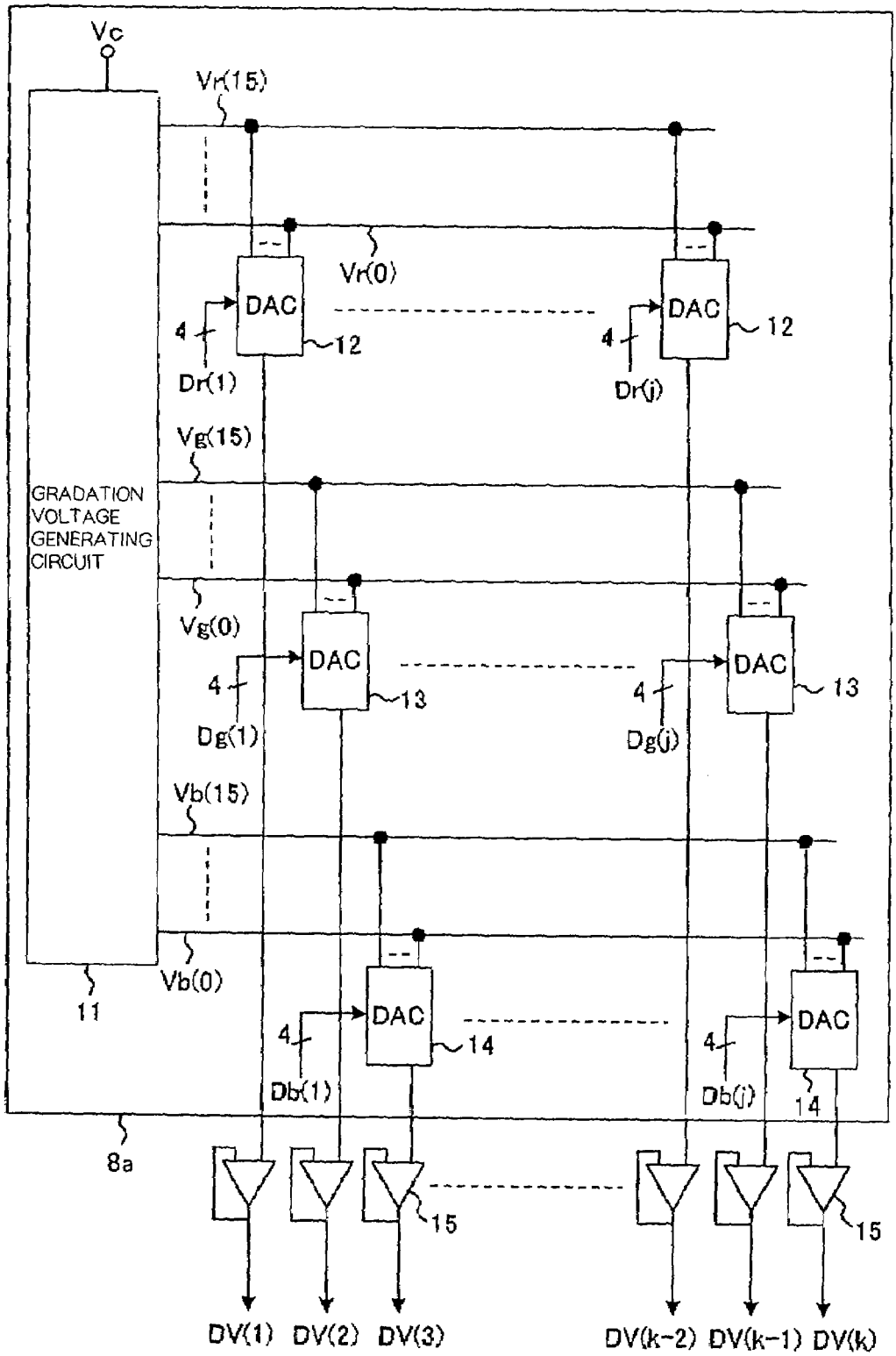
FIG. 7 is a block diagram of a drive voltage generating circuit in a data line driver according to an embodiment of the present invention.

Drive voltage generating circuit 8*a* shown in FIG. 7 supplies 16 red gradation voltages Vr(0) through Vr(15), 16 green gradation voltages Vg(0) through Vg(15), and 16 blue gradation voltages Vb(0) through Vb(15) respectively to red DACs 12, green DACs 13, and blue DACs 14. Therefore, a total of 48 lines extend in and across drive voltage generating circuit 8*a*. In FIG. 13, however, only 40—lines for supplying reference voltages V(0) through V(39) extend in and across drive voltage generating circuit 8*b*. Therefore, the number of lines used in drive voltage generating circuit 8*b* is reduced, making it possible to reduce the size of drive voltage generating circuit 8*b*. The above description is based on the 4-bit input data for each color. If input data for each color is of 8 bits, then since 256 gradation voltages are required for each color, drive voltage generating circuit 8*a* shown in FIG. 7 needs a total of 768 lines. Even if drive voltage generating circuit 8*b* shown in FIG. 13 uses 500 reference voltages, the number of lines employed therein may be 268 smaller than the number of lines employed in drive voltage generating circuit 8*a* shown in FIG. 7. Therefore, the size of drive voltage generating circuit 8*b* can definitely be reduced compared with drive voltage generating circuit 8*a* shown in FIG. 7.

According to the present invention, as described above, the data line driver selects and outputs m red gradation voltages, m green gradation voltages, and m blue gradation voltages from n reference voltages (n>m) that are generated by a single resistor string having n reference voltage terminals for providing all of a gamma correction curve for red, a gamma correction curve for green, and a gamma correction curve for blue, using the single resistor string and a pair of high- and low-potential power supplies. According to the first background art, a resistor string and a dedicated power supply need to be provided for each of red, green, and blue. According to the present invention, however, the number of resistor strings and the number of power supplies are greatly reduced, making it possible for the data line driver to be small in size and consume low electric power, compared with the first background art. According to the present invention, furthermore, since the number of gradation voltages is not increased unlike the second background art, output gradation voltages are prevented from being saturated when digital input data are converted into analog output data, thus avoiding color irregularities on displayed images, and allowing color images that are well balanced among red, green, and blue to be displayed on the display panel.

While preferred embodiments of the present invention have been described using specific terms, such description is for illustrative purposes only, and it is to be understood that changes and variations may be made without departing from the spirit or scope of the following claims.

What is claimed is:

1. A display panel driver for being supplied with digital data for displaying red, green, and blue on a display panel having display elements, correcting differences between light-emission characteristics of the display elements for red, green, and blue using m gradation voltages for each of red, green, and blue, and generating and outputting drive voltages for data lines of the display panel, said display panel driver comprising:

voltage generating means for generating reference voltages, said voltage generating means having a plurality of resistors connected in series between a first voltage power supply which supplies high-voltages and a second power supply which supplies low-voltage, and n reference voltage terminals, which are more than said m gradation voltages, connected to respective junctions at which said resistors are connected; and voltage selecting means for selecting and outputting m red gradation voltages, m green gradation voltages, and m blue gradation voltages from the reference voltages supplied from said n reference voltage terminals.

2. A display panel driver according to claim 1, wherein said resistors of the voltage generating means have respective resistances set to the same value.

3. A display panel driver according to claim 1, wherein said voltage selecting means comprises:

n reference voltage input lines extending in a first direction and connected to said voltage generating means;

m red gradation voltage output lines, m green gradation voltage output lines, and m blue gradation voltage output lines, all extending in a second direction perpendicular to said first direction; and connecting means disposed at points of intersection between lines in said first direction and lines in said second direction, for selectively connecting red gradation voltage output lines to one of the n reference voltage input lines, selectively connecting green gradation voltage output lines to one of said reference voltage input lines, and selectively connecting blue gradation voltage output lines to one of said reference voltage input lines.

4. A display panel driver according to claim 3, wherein said connecting means comprises vias disposed at the points of intersection between the lines in said first direction and the lines in said second direction and interconnecting the lines in said first direction and the lines in said second direction.

5. A display panel driver according to claim 3, wherein said connecting means comprises:

switches disposed at the points of intersection between the lines in said first direction and the lines in said second direction; and a switch control circuit for selecting and rendering conductive one of n switches connected to each of said red gradation voltage output lines, selecting and rendering conductive one of n switches connected to each of said green gradation voltage output lines, and selecting and rendering conductive one of n switches connected to each of said blue gradation voltage output lines.

6. A display panel driver for being supplied with digital data for displaying red, green, and blue on a display panel having display elements, correcting differences between light-emission characteristics of the display elements for red, green, and blue using m gradation voltages for each of red, green, and blue, and generating and outputting drive voltages for data lines of the display panel, said display panel driver comprising:

voltage generating means for generating reference voltages, said voltage generating means having a plurality of resistors connected in series between a first voltage power supply which supplies high-voltages and a second voltage power supply which supplies low-voltages, and n reference voltage terminals, which are more than said m gradation voltages, connected to respective junctions at which said resistors are connected;

voltage selecting means for selecting and outputting m red gradation voltages, m green gradation voltages, and m blue gradation voltages from the reference voltages supplied from said n reference voltage terminals;

red digital-to-analog converters each for selecting and outputting one of said m red gradation voltages based on digital input data supplied thereto;

green digital-to-analog converters each for selecting and outputting one of said m green gradation voltages based on digital input data supplied thereto; and blue digital-to-analog converters each for selecting and outputting one of said m blue gradation voltages based on digital input data supplied thereto.

7. A display panel driver according to claim 6, wherein said voltage selecting means comprises;

red voltage selecting means associated respectively with said red digital-to-analog converters, for supplying m red gradation voltages selected from said n reference voltages;

green voltage selecting means associated respectively with said green digital-to-analog converters, for supplying m green gradation voltages selected from said n reference voltages; and blue voltage selecting means associated respectively with said blue digital-to-analog converters, for supplying m blue gradation voltages selected from said n reference voltages.

* * * * *